US005503687A

United States Patent [19]

Berns

[11] Patent Number: 5,503,687

[45] Date of Patent: Apr. 2, 1996

[54] NITROGEN ENRICHMENT OF SURFACE AND NEAR SURFACE REGIONS TO PRODUCE A HIGH-STRENGTH AUSTENITIC SURFACE LAYER IN STAINLESS STEELS

[76] Inventor: Hans Berns, Löwenzahnweg 11a, 44797 Bochum, Germany

[21] Appl. No.: 319,460

[22] Filed: Oct. 5, 1994

[30] Foreign Application Priority Data

Oct. 5, 1993 [DE] Germany ..... 43 33 917.4

[51] Int. Cl.[6] ..... C23C 8/26

[52] U.S. Cl. ..... 148/230; 148/232

[58] Field of Search ..... 148/230, 232, 148/318

[56] References Cited

U.S. PATENT DOCUMENTS 4,154,629 5/1979 Asai et al. .

FOREIGN PATENT DOCUMENTS 2518452 1/1976 Germany .
4033706 2/1991 Germany .
4036381 8/1991 Germany .
60-159116 8/1985 Japan ..... 148/232
5222512 8/1993 Japan ..... 148/230

OTHER PUBLICATIONS

H.–J. Spies; "Stand und . . . Gasnitrierens"; Neue Hutte, vol. 36, No. 7, Jul. 1991, Leipzig, Germany, pp. 255–262.

H. Berns; "Nichtrostende . . . Stickstoffgehalt"; VDI Zeit–Schrift, vol. 136, No. 1/2, 1994, Dusseldorf, pp. 74–76.

*Primary Examiner*—Deborah Yee

*Attorney, Agent, or Firm*—Robert W. Becker & Associates

[57] ABSTRACT

Enrichment of surface and near surface regions of stainless steel components that nearly have their final shape with dissolved nitrogen at temperatures between 1000° and 1200° C. is provided. In this way, ferritic and martensitic structure portions in the surface zone are changed to austenite. By means of mixed crystal hardening, nitrogen increases the strength of the surface layer that is formed and that at the same time is characterized by the degree of toughness of the austenitic structure. The combination of strength and toughness leads to a significantly increased resistance to wear, especially wear due to impact, cavitation, and impingement of drops. In contrast to carbon, the resistance to corrosion of the surface layer is not adversely affected when nitrogen diffuses in, but rather is even further increased. The thermal treatment process is suitable for increasing the service life of rust proof components in flow-producing mechanisms.

9 Claims, 3 Drawing Sheets

200μm

STRUCTURE AT THE TRANSITION FROM THE NITROGEN ENRICHED SURFACE REGION TO THE CORE OF THE STAILESS FERRITIC-AUSTENITIC DUPLEX STEEL X2CrNiMoN 22 5 3.

NITROGEN ENRICHMENT OF SURFACE AND NEAR SURFACE REGIONS TO PRODUCE A HIGH-STRENGTH AUSTENITIC SURFACE LAYER IN STAINLESS STEELS

BACKGROUND OF THE INVENTION

In stainless steels, dissolved carbon and nitrogen increase the hardness of the martensite, the yield point of the austenite, and effect a stabilization of the austenitic phase. Whereas the addition of carbon adversely affects the resistance of stainless steel to corrosion from moisture, nitrogen effects an enhancement of this property. Standing in the way of the utilization of this favorable effect of nitrogen is, in contrast to carbon, its considerably lower solubility in the molten steel at normal pressure. For this reason, pressure and powder metallurgy techniques are used these days in order to produce stainless steels having a nitrogen content between 0.3 and 3% by weight. However, these techniques are far more expensive than an open steel smelting process.

German Patent 40 33 706 describes casehardening with nitrogen, whereby after the nitrogen enrichment of a martensitic stainless steel by hardening, a hard, martensitic surface layer is produced over a ductile core. This process is used for treating rust proof ballbearings, transmission parts and tools, as well as for rust proof pump parts and valves in particle-laden fluids. In all of these cases, the concern is with maximum resistance to pressure and hardness of the surface layer, which however is accompanied by significant brittleness.

SUMMARY OF THE INVENTION

In contrast, it is therefore an object of the present invention to provide as high-strength yet tough of an austenitic surface layer over a ductile or hard core (FIG. 1) as possible. In this connection, by having nitrogen diffuse in, the austenitic phase in the surface layer is stabilized, so that martensitic of ferritic structure portions in the surface zone are converted to austenite. At the same time, due to the mixed crystal hardening of the austenite with nitrogen, the strength of the surface layer is increased without brittleness occurring. As a consequence of the achieved combination of strength and toughness, the inventive austenitic surface layer is suitable for increasing the resistance to wear, especially where stress is caused by wear from impact, cavitation, and impingement of drops, as occur, for example, in flow-producing mechanisms.

The present invention dispenses with a continuous high nitrogen content in the steel. Rather, only the surface and near surface zones of stainless steel components that are nearly in their final shape are enriched via a thermal treatment with dissolved nitrogen to such an extent that a high-strength yet tough austenitic surface layer is formed over a core structure of ferrite, austenite, martensite, or a mixture of two or three of these structure constituents. The inventive thermal treatment comprises nitrogen enrichment in a nitrogen-yielding gas atmosphere at a temperature of between 1000° and 1200° C. The temperature, pressure and duration of the treatment are selected in such a way that a surface layer having a specific thickness is formed, with the nitrogen content in the surface layer being between a lower limit of 0.3% by weight and an upper limit that is provided by the beginning of nitride separation during the nitrogen enrichment. The subsequent cooling is effected so rapidly that also during this period of time no nitride separation occurs. By means of a subsequent holding at a temperature of ≦650° C, a hardening or tempering of the surface layer is possible.

BRIEF DESCRIPTION OF THE DRAWINGS

The present invention will be described with the aid of an exemplary embodiment in conjunction with the following drawings, in which.

DESCRIPTION OF A PREFERRED EMBODIMENT

Figure 1:
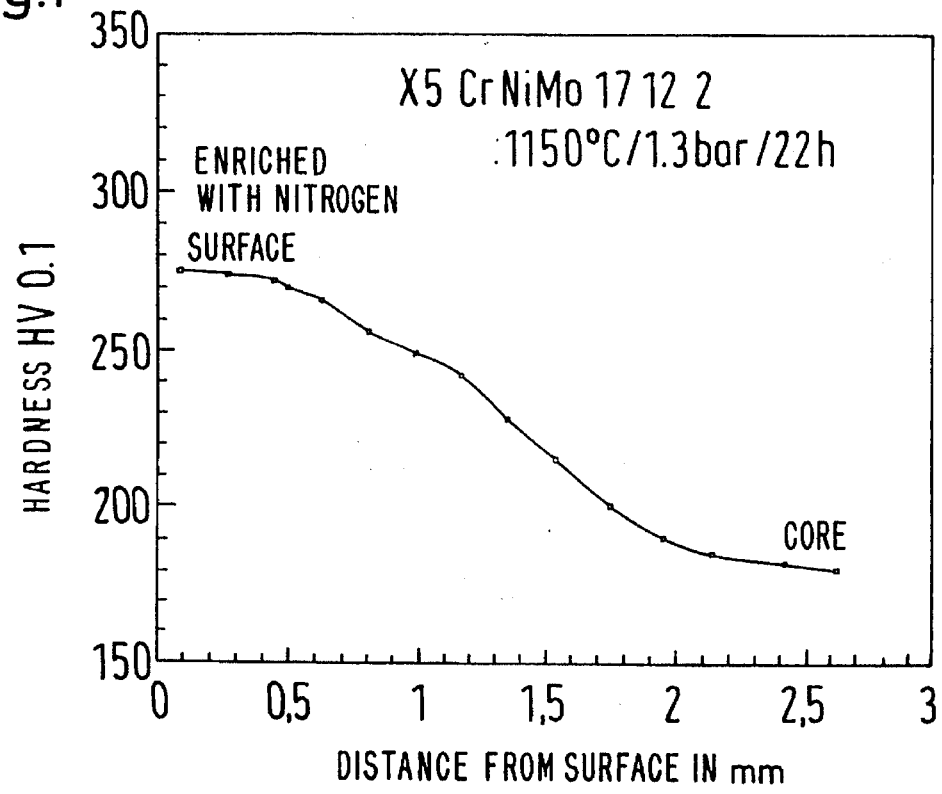
FIG. 1 is a hardness curve in the nitrogen enriched surface layer of an austenitic stainless steel.
Figure 2:
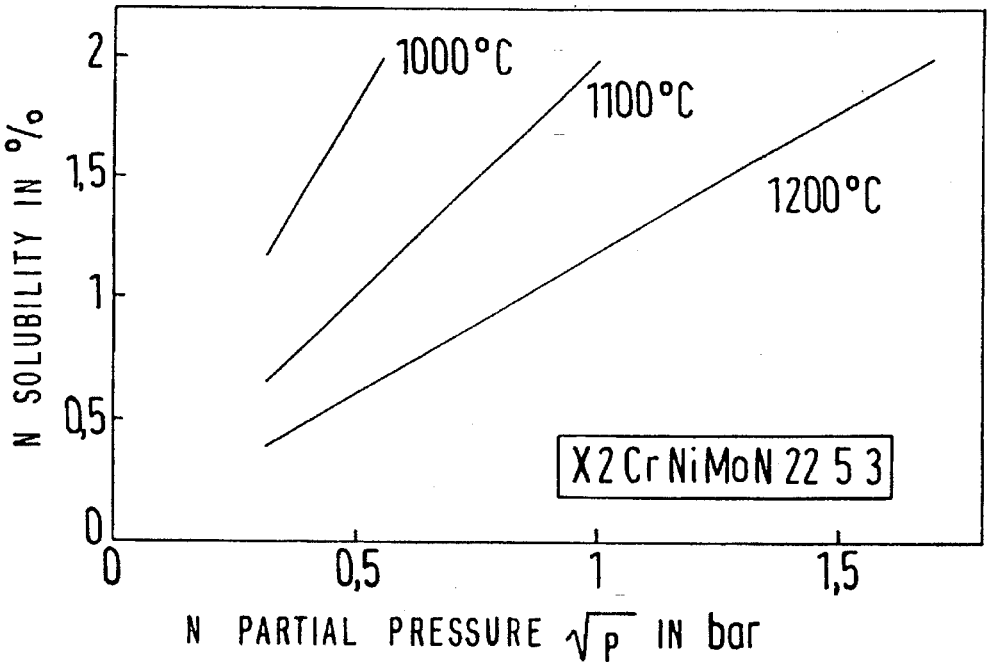
FIG. 2 shows the nitrogen solubility as a function of temperature and nitrogen pressure for an example of a stainless duplex steel.
Figure 3:
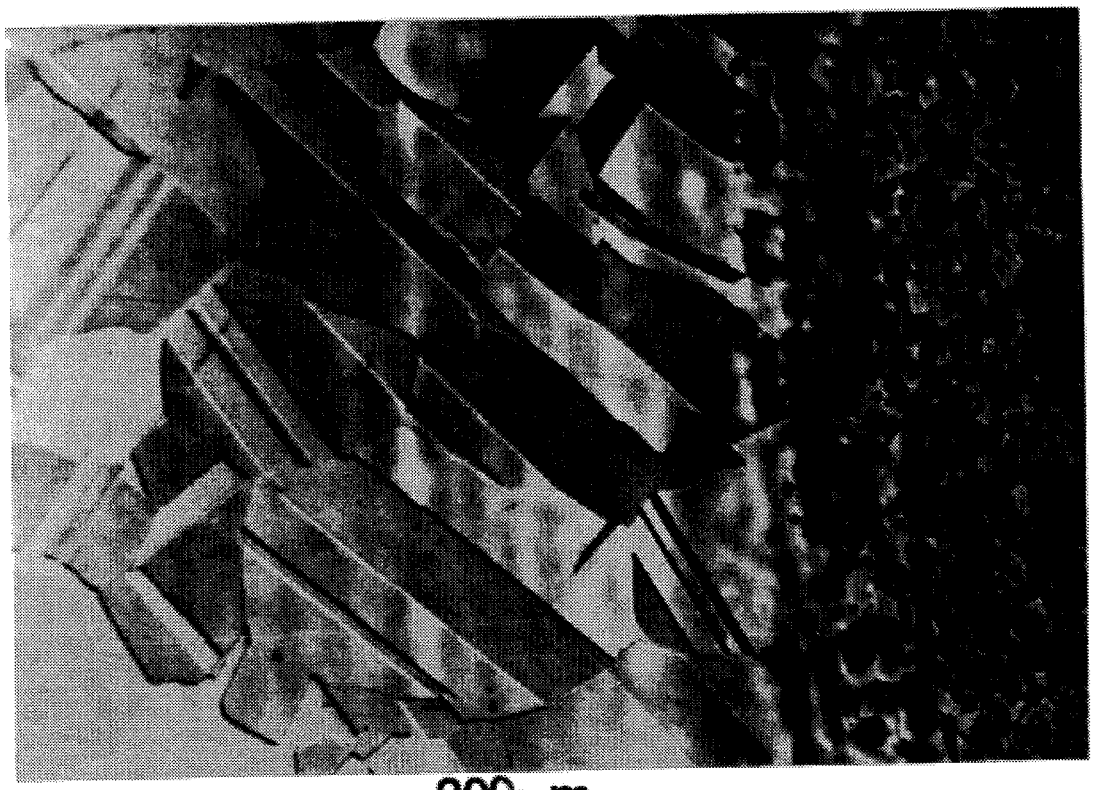
FIG. 3 shows the structure at the transition from the nitrogen enriched surface region to the core of the stainless ferritic-austenitic duplex steel X 2 CrNiMoN 22 5 3.
Figure 4:
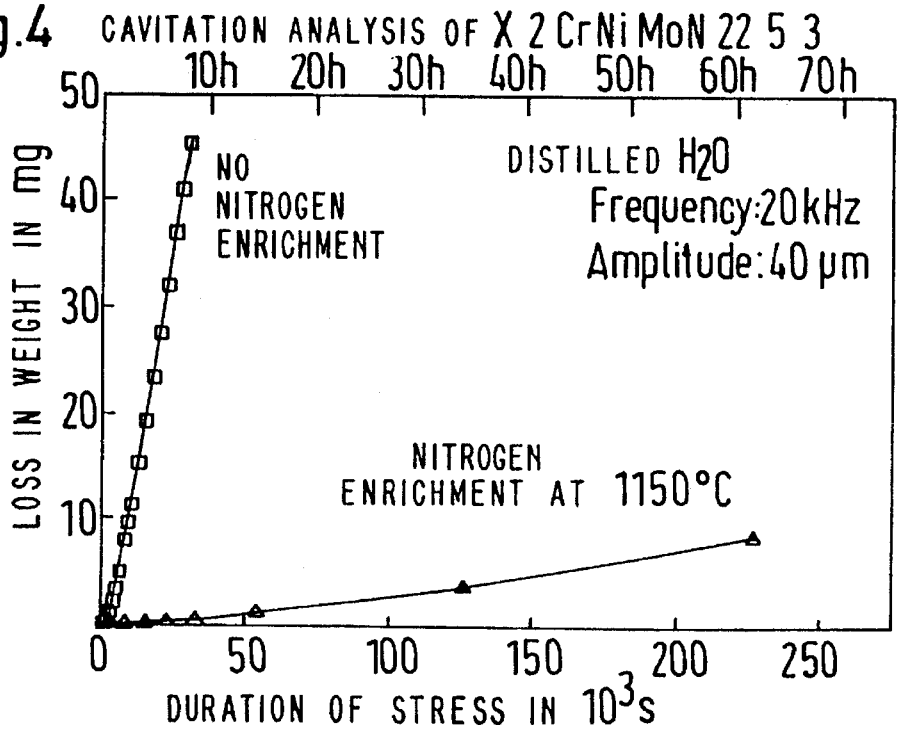
FIG. 4 shows the loss in weight for the cavitation analysis of a stainless duplex steel in comparison to the nitrogen enriched surface of the same steel.
Figure 5:
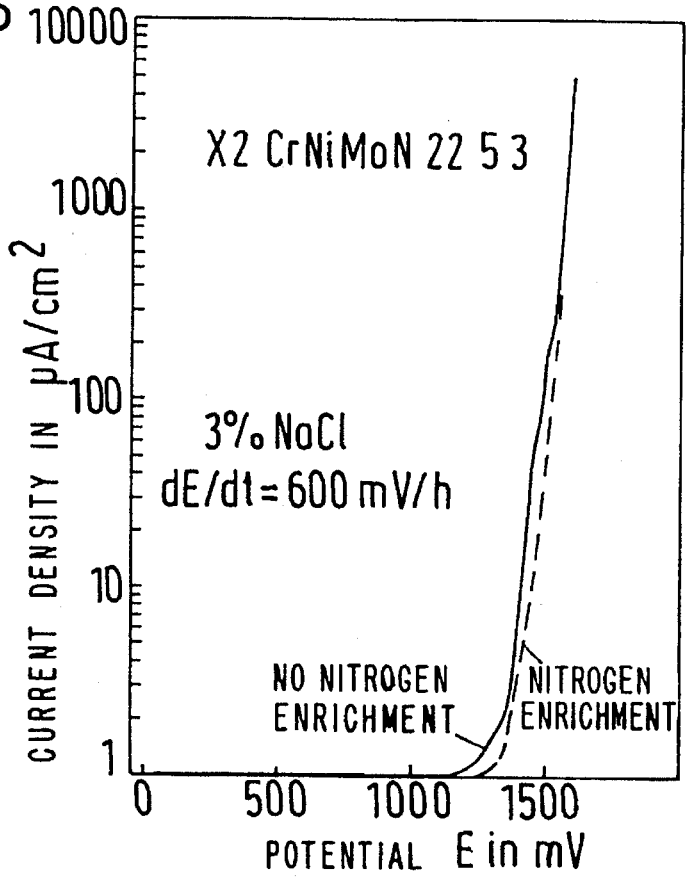
FIG. 5 shows current density-potential curves in an aqueous 3% by weight NaCl solution for a stainless duplex steel prior to and after enrichment with nitrogen.

For high-speed pump gears and impellers employed in corrosive media, ferritic-austenitic stainless duplex steels are frequently used, because the two-phase structure has the required high yield point. A frequent type of failure is wear due to cavitation. As can be seen from FIG. 2, by means of nitrogen enrichment in nitrogen gas at 1150° C. and a pressure of one bar, ≧1.4% by weight nitrogen is dissolved in the surface zone of this material. After being cooled down or quenched, a completely austenitic surface layer over a ferritic-austenitic core structure results, as can be seen from FIG. 3. In comparison to the non nitrogen enriched core material, this surface layer was subjected to a cavitation wear analysis. In this connection, a cavitation field is generated by an ultrasonic resonator at 20 kHz and an amplitude of 40 μm in distilled water; this leads to implosions at the surface of the specimen. In FIG. 4, the amount of wear is plotted as a loss in weight against the duration of stress or load. The rate of wear for the inventively nitrogen enriched surface layer is 0.0356 ($mg/10^3s$), whereas the rate of wear for steel that has not been nitrogen enriched is 1.53 ($mg/10^3s$). Thus, by enriching the surface and near surface regions with nitrogen, a reduction in the rate of wear by a factor of 43 is achieved. From the example of a current density potential curve shown in FIG. 5, it can be seen that the resistance to corrosion from moisture in synthetic ocean water is readily improved by the nitrogen enrichment of the surface and near surface. At approximately the same passive current density, the break-down potential for the nitrogen enriched specimen is increased relative to the non-nitrogen enriched specimen.

Applied to a pump gear, these test results mean that the high yield point of the ferritic-austenitic duplex structure in the core and hence the load-carrying capacity at high speeds of rotation are maintained. At the same time, the cavitation wear rate is significantly reduced due to the nitrogen enriched austenitic surface layer until this layer is consumed. With respect to cost, the thermal treatment, comprising annealing the solution at 1020° to 1100° C., and quenching, which are customary for duplex steels, are eliminated. In place thereof, the present invention provides for the nitrogen enrichment and quenching, so that the only extra expense is for a longer treatment time and for the gas atmosphere.

The present invention is, of course, in no way restricted to the specific disclosure of the specification and drawings, but also encompasses any modifications within the scope of the appended claims.

What I claim is:

1. A thermal treatment process to form an austenitic surface and near surface layer having ≧0.30% by weight dissolved nitrogen in a stainless steel component that nearly has its final shape, said process including the steps of:

enriching said component with nitrogen at a temperature of from 1000° to 1200° C. in a nitrogen-containing gas atmosphere; and subsequently cooling down said component at such a rate that nitride separation is avoided.

2. A thermal treatment process according to claim 1, wherein a stainless austenitic steel is used.

3. A thermal treatment process according to claim 1, wherein a stainless martensitic steel is used.

4. A thermal treatment process according to claim 1, wherein a stainless ferritic steel is used.

5. A thermal treatment process according to claim 1, wherein a stainless ferritic-austenitic steel is used.

6. A thermal treatment process according to claim 1, wherein a stainless ferritic-martensitic steel is used.

7. A thermal treatment process according to claim 1, wherein said gas atmosphere is at a pressure during said nitrogen enrichment that is other than standard pressure.

8. A thermal treatment process according to claim 1, which includes the further step of subsequently reheating said surface and near surface layer to a temperature of ≦650° C. to harden said layer.

9. The thermal treatment process of claim 1 to improve resistance to wear.

* * * * *